US006502432B1

(12) United States Patent
Benekian et al.

(10) Patent No.: US 6,502,432 B1
(45) Date of Patent: Jan. 7, 2003

(54) MACHINE FOR WET ROPE FORM TREATMENT

(75) Inventors: Jean-Paul Benekian, Meyzieu (FR); Gerard Perret, Montanay (FR); Marc Roussel, Montanay (FR)

(73) Assignee: Alliance Machines Textiles (FR)

( * ) Notice: Subject to any disclaimer, the term of this patent is extended or adjusted under 35 U.S.C. 154(b) by 0 days.

(21) Appl. No.: 09/674,802

(22) PCT Filed: Apr. 30, 1999

(86) PCT No.: PCT/FR99/01039

§ 371 (c)(1),
(2), (4) Date: Feb. 23, 2001

(87) PCT Pub. No.: WO99/57357

PCT Pub. Date: Nov. 11, 1999

(30) Foreign Application Priority Data

May 5, 1998 (FR) ..... 98 05907

(51) Int. Cl.[7] ..... D06B 3/28
(52) U.S. Cl. ..... 68/20; 68/177
(58) Field of Search ..... 68/177, 178, 20

(56) References Cited

U.S. PATENT DOCUMENTS 4,468,937 A * 9/1984 Bertoldi ..... 68/177 X
4,766,743 A * 8/1988 Biancalani et al. ..... 68/177 X

FOREIGN PATENT DOCUMENTS

| | | |
|---|---|---|
| EP | 0334749 | * 9/1989 |
| EP | 0441080 | * 8/1991 |
| EP | 0512189 | * 11/1992 |

* cited by examiner

*Primary Examiner*—Philip Coe
(74) *Attorney, Agent, or Firm*—Cantor Colburn LLP

(57) ABSTRACT

This machine for wet treatment, for example dyeing, for textile materials, comprises a horizontally elongate vat, in which is formed a zone for the storage in folds of the fabric to be treated, which forms a rope closed on itself. A hydraulic and/or mechanical system for driving the fabric is placed at the start of a transport tube provided for returning the fabric from the front end of the vat toward the rear end of the latter. A system for injecting a gas stream, for example air, in contact with the fabric is provided within the vat; the system is located, in the direction of travel of the fabric, between the point where this fabric returns to the storage zone and the hydraulic system. This system spreads and dries the fabric.

The invention is used for the fault-free dyeing of fabrics composed of modern fibers.

12 Claims, 2 Drawing Sheets

1
2
3
4
5
6
7
8
9
10
11
12
13
14
15
16
17
18
19
20
21
22
23
24
25
26

1
7
17
20
21
26

1
2
3
4
6
7
8
9
10
11
12
13
14
15
16
17
20
21
22
23
24
25
26

MACHINE FOR WET ROPE FORM TREATMENT

TECHNICAL FIELD

The present invention relates to a machine for wet treatment in rope form, for textile materials, for example a machine for the dyeing of fabrics, more specifically a machine of elongate shape. The invention will be more particularly described hereafter within the framework of its application to a dyeing machine.

BACKGROUND OF THE INVENTION

There are various types of dyeing machine, in particular beam-dyeing autoclaves, with which the present invention is not concerned, and machines for dyeing in rope form, more particularly under consideration here, in which the fabric to be treated forms a "rope" closed on itself, which follows a looped circuit within the machine, at the same time passing through a transport zone and a storage zone. The machines for dyeing in rope form comprise, in turn, machines of which the vat for storing the fabric is of round general shape and other machines of which the vat for storing the fabric is of elongate shape.

SUMMARY OF THE INVENTION

In the machines of round shape, the fabric is driven by mechanical, hydraulic or aeraulic means. The drive may also be carried out by a combination of the abovementioned means. Examples of such machines which may be cited here are U.S. Pat. Nos. 3,921,420 and 3,949,575 or European Patent Application No. 0334749. These machines have, in general terms, the disadvantage that the fabric is crushed in the storage zone.

In the machines of elongate shape, the fabric storage vat is horizontal or of a shape and orientation close to the horizontal, and the circuit of the fabric is closed above or below the horizontal storage zone. The fabric is driven by mechanical or hydraulic means or by a combination of these two types of means; as regards the hydraulic means, these involve a drive system employing the dyeing bath itself which is suitably set in motion. The essential feature of the machines of elongate shape is that the textile material is stored in folds, without crushing, or, more precisely, that each elementary length of fabric undergoes the same crushing during the entire storage, in contrast to a machine of round shape, in which the fabric undergoes different compression, depending on whether it is located at the start, in the middle or at the end of the storage zone. Examples of machines of elongate shape which may be cited here are German Patent Application No. 2207679 and U.S. Pat. No. 3,802,840.

All these known machines still give rise to faults on the fabrics to be dyed, in particular faults of the "pill" or "crow's foot" type or faults of the dye "crease" type. These faults are found with increasing frequency on account of the new treated textile materials which comprise elastomeric threads in the weft direction and/or warp direction in increasingly large proportions.

The object of the present invention is to eliminate this type of fault, while making it possible to speed up the treatment of some of these textile materials.

For this purpose, the subject of the invention is essentially a machine for wet treatment in rope form, of the type including a machine of elongate shape, comprising a horizontally elongate vat, in which is formed a zone for the storage in folds of the fabric to be treated, and hydraulic and/or mechanical means for driving the fabric, which are placed preferably at the start of a transport tube or duct provided for returning the fabric from the front end of the vat toward the rear end of this vat, the fabric forming a rope closed on itself, this machine being characterized in that means for injecting a gas stream in contact with the fabric are provided within said vat or in the surroundings of this vat, the means for injecting a gas stream being located, in the direction of travel of the fabric, between the point where this fabric returns to the storage zone and the hydraulic and/or mechanical means for driving the fabric.

Thus, the invention proposes a machine for wet treatment, for example dyeing, of elongate shape, in which a system for the injection of gas, such as air, is installed, this system being arranged in the path of the fabric, within the fabric storage vat or in its immediate vicinity, and taking action after the fabric has been transported from the front of the machine toward the rear and before said fabric is taken up by the system for the hydraulic drive of the machine (if appropriate, assisted by mechanical means).

The choice of an elongate machine eliminates the faults attributable to the crushing of the textile material, and the gas injection system eliminates the dye "creases" by virtue of its function of spreading and drying the material. In this respect, it will be noted that, here, the gas injection means do not ultimately drive the fabric forward, but essentially unfold it and dry it. After having been spread in this way, the textile material is once again returned to rope form and stored in folds, but in folds different from those of the preceding lay, and so on and so forth. At the end of the complete treatment cycle, which may last from a few minutes to eight hours or more, the fabric will have changed folds at each lay and will therefore be treated in a perfectly uniform manner without "creases". The action of the gas stream makes it possible, here, to reduce very significantly the times for treating the materials, while improving the treatment quality, in particular the stability of the materials during use, including modern textile fibers which present problems in this respect (viscose which is produced in solutions based on recovered solvent and which is used alone or in a mixture with other materials).

Adapting the volume and pressure of the injected gas makes it possible to adjust the treatment to the material and thereby succeed in this treatment.

According to one embodiment of the invention, the means for injecting a gas stream are located, within the storage vat, in the region of the rear end of this vat, along the path of the fabric, downstream of the issue of the tube or duct for returning the fabric to the vat. A deflecting roller, driven in rotation or free, can be arranged on the path of the fabric, between the issue of said return tube or duct and the means for injecting a gas stream.

According to another embodiment of the invention, the return tube or duct is prolonged by a tube, in particular a bent tube, within the storage vat, the latter tube having its downstream end connected directly to the means for injecting a gas stream.

Advantageously, said means for injecting a gas stream comprise a gas injection nozzle placed within the vat and connected to a fan located outside this vat, the fan comprising at least one gas intake in the upper part of said vat. Preferably, a plurality of gas intakes distributed over the length of the vat will be provided for the fan.

According to another possibility, the means for injecting a gas stream are located outside the vat, in particular on a branch duct through which the fabric to be treated passes.

BRIEF DESCRIPTION OF THE DRAWINGS

The invention will at all events be understood better and other characteristics disclosed with the aid of the following description, with reference to the accompanying diagrammatic drawing which illustrates, by way of example, some embodiments of this machine for wet treatment in rope form and in which.

DETAILED DESCRIPTION OF THE PREFERRED EMBODIMENT

Figure 1:
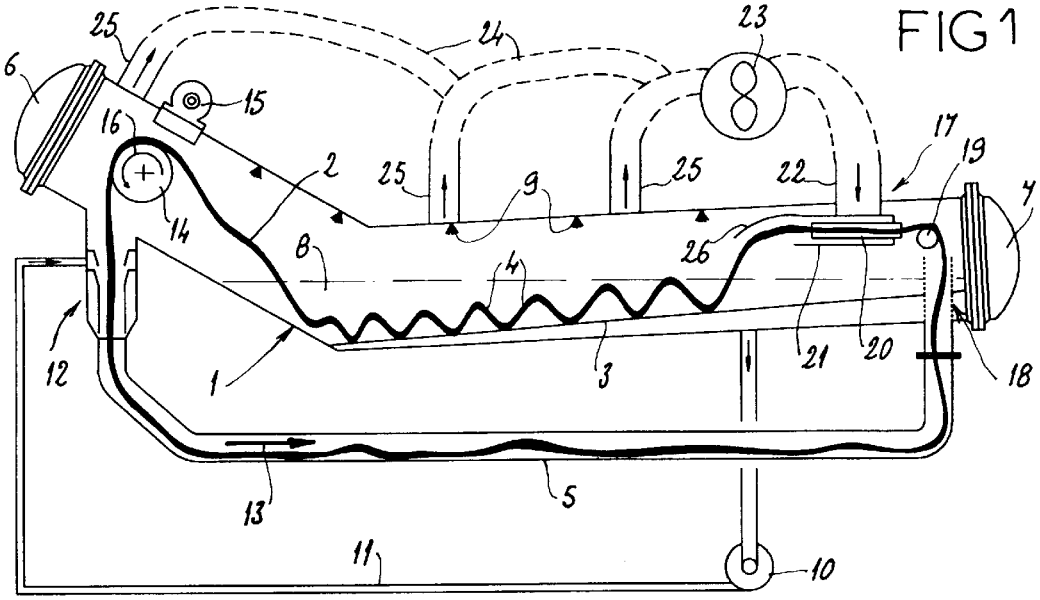
FIG. 1 is a view in longitudinal section of a first embodiment of a dyeing machine according to the present invention.

In a generally known way, the machine for dyeing in rope form, illustrated in the drawing, comprises a horizontally elongate vat 1 which forms a storage zone for the textile material 2 to be treated, the latter forming a "rope" closed on itself and following a looped circuit. Placed in the vat 1 is a perforated basket 3, on which rest the numerous folds 4 formed in the storage zone by the fabric in rope form 2 which is thereby held at a distance from the bottom of the vat 1 at least over part of the length of the latter.

A transport tube 5 extending from the region of one end 6 of the vat 1, referred to as the front end, returns to the region of the other end 7 of the vat 1, referred to as the rear end, the tube 5 forming a return duct for the fabric in rope form 2.

A pump 10 sucks up the dyeing bath 8 at the bottom of the vat 1 and delivers this bath 8 in a tube 11 as far as a hydraulic drive system 12 placed in the region of the front end 6 of the vat 1, at the starting point of the transport tube 5, the hydraulic system 12 ensuring that the fabric in rope form 2 is displaced according to the arrow 13. A spray rail 9 located in the upper part of the vat 1 recycles part of the dyeing bath 8 within the vat 1.

In the examples illustrated in the drawing, the dyeing machine also comprises, in the region of its front end 6, a mechanical system for driving the fabric 2, said system consisting of a drive roller 14 of horizontal axis, housed in the vat 1 above the hydraulic system 12, and of a motor 15 placed outside the vat and coupled to the roller 14 so as to drive the latter in rotation according to the arrow 16.

According to the invention, the dyeing machine comprises, furthermore, an air injection system or aeraulic system, designated as a whole by the reference 17, which is arranged on the circuit along which the fabric in rope form 2 travels and which serves for spreading this fabric.

Figure 2:
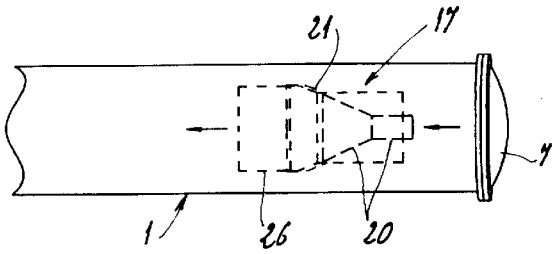
FIG. 2 is a partial plan view from above of the dyeing machine of FIG. 1.

In the first embodiment, illustrated in FIGS. 1 and 2, the aeraulic system 17 is located in the region of the rear end 7 of the vat 1, and it thus has passing through it the fabric in rope form 2 which is returned by way of the transport tube 5 to this end 7 of the vat 1.

More particularly, at its issue into the vat 1 (in the region of the rear end 7), the transport tube 5 is prolonged upward, within the vat 1, by a short perforated tube 18 of substantially vertical axis, itself surmounted by a deflecting roller 19 which is loose or is driven in rotation and has a horizontal axis.

The aeraulic system 17 is arranged within the vat 1, and in the upper part of the latter, just downstream of the deflecting roller 19. Said system comprises an inner duct 20 which is widened and flattened horizontally (see FIG. 2) and through which the fabric 2 passes, and an outer nozzle 21. The nozzle 21 is connected by means of an air delivery duct 22 to the outlet of a fan 23 placed outside the vat 1. The "suction" side of the fan 23 is connected by means of suitable ducts 24 to a plurality of air intakes 25 located in the upper part of the vat 1 and distributed over the length of this vat 1.

Thus, when the dyeing machine is in operation, the fabric in rope form 2, returned to the rear end 7 of the vat 1 by way of the transport tube 5, first arrives at the aeraulic system 17, where the action of the air pulsed by the fan 23 and injected by the nozzle 21 causes the spreading of the fabric 2, before the latter reforms the folds 4; this spreading of the fabric, in turn, brings about a uniform distribution of the chemical agents which treat the fabric 2. Advantageously, the nozzle 21 of the aeraulic system 17 is prolonged forward by a deflector 26, preferably adjustable from the outside, which turns the fabric 2 downward in order to induce it to form the folds 4. The fact that the fan 23 has a plurality of air intakes 25 makes suction as homogeneous as possible. Moreover, inasmuch as the air is ejected in the direction of advance of the fabric 2 by the nozzle 21, the aeraulic system 17 can also contribute to driving the fabric 2.

Figure 3:
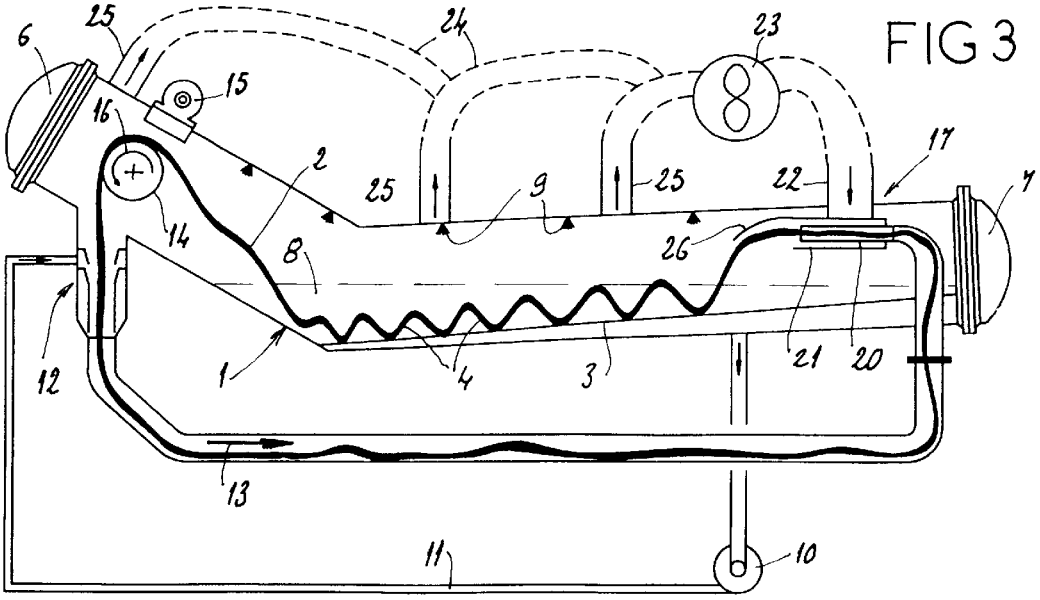
FIG. 3 is a view in longitudinal section of a second embodiment of the dyeing machine according to the invention.

FIG. 3 illustrates a second embodiment which is a variant of that described above. The aeraulic system 17, here, is still placed in the region of the rear end 7 of the vat 1, and the structure of this actual system is not modified (the parts corresponding to the preceding description being designated by the same references and not being described again). The only difference is that, at its issue into the vat 1 (in the region of the rear end 7), the transport tube 5 is prolonged upward and forward, within the vat 1, by a bent tube 27, the downstream end of which is connected directly to the widened inner duct 20 belonging to the aeraulic system 17.

Figure 4:
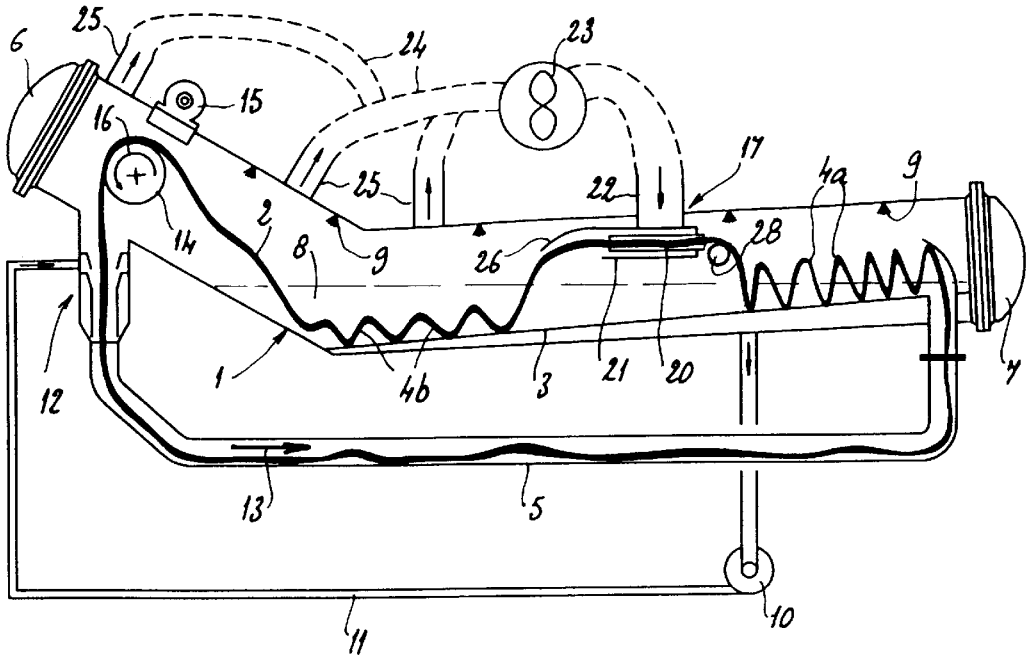
FIG. 4 is a view in longitudinal section of a third embodiment of the dyeing machine according to the invention.

FIG. 4 illustrates a third embodiment, in which the aeraulic system 17, of unmodified structure, is arranged further downstream in an intermediate region of the vat 1. Thus, the storage zone is divided into two parts: here, the fabric in rope form 2 forms a first series of folds 4*a*, which is located between the rear end 7 of the vat 1 and a deflecting roller 28 located at the entrance of the aeraulic system 17, and a second series of folds 4*b*, which is located between the exit of the aeraulic system 17 and the front end 6 of the vat 1.

Figure 5:
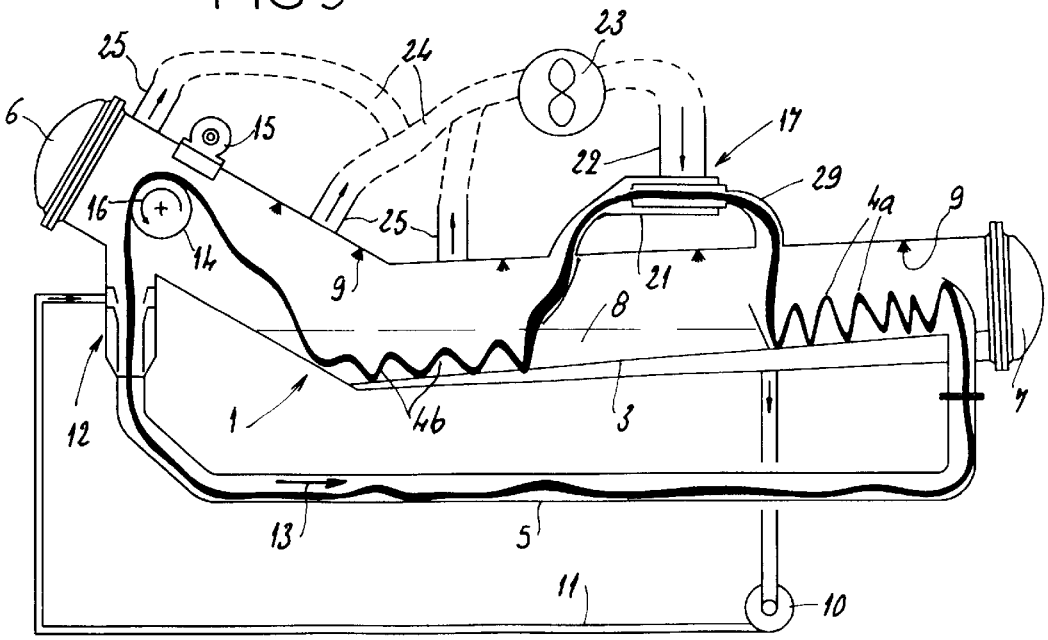
FIG. 5 is a view in longitudinal section of a fourth embodiment of this dyeing machine.

FIG. 5 illustrates a fourth embodiment, in which the aeraulic system 17 is arranged outside the vat 1, above the latter. The aeraulic system 17 is inserted on a branch duct 29 which is located in an intermediate region of the length of the vat 1 and through which the fabric 2 passes. As before, here, the fabric in rope form forms a first series of folds 4*a* upstream of the aeraulic system 17 and a second series of folds 4*b* downstream of this aeraulic system 17.

It goes without saying that the invention is not limited only to the embodiments of this machine for wet treatment in rope form which were described above by way of example; on the contrary, it encompasses all the variants in terms of implementation and use which adhere to the same principle. In particular, the scope of the invention would not be exceeded:

by providing, for the aeraulic system 17, a fan 23 provided with a single air intake 25;

by shifting the aeraulic system 17 forward, in particular by locating it in the vat 1 in front of all the folds 4 of the fabric in rope form 2, just upstream of the drive roller 14;

by dispensing with the mechanical system for driving the fabric, comprising this roller 14, and by thereby managing with the hydraulic drive system 12 or managing with a loose deflecting roller;

by changing the spatial arrangement of particular components of the machine, for example: the fan 23 may be placed in the region of the rear end 7 of the vat 1, even within this vat if the geometrical shapes of the latter and of the fan allow it, and the transport tube 5 may be located on the side of the vat 1 or above this vat or else within the vat 1 itself;

by replacing the aeraulic system with means for injecting a gas other than air, for example an inert gas;

by no longer applying the same design to a dyeing machine, but to machines carrying out other so-called "wet" treatments, such as: bleaching, desizing, soda treatment, enzyme treatment or any similar treatments in an aqueous medium.

What is claimed is:

1. A machine for wet treatment for textile materials, comprising:

a horizontally elongate vat, in which is formed a storage zone for storing folds of a fabric to be treated;

hydraulic and/or mechanical means for driving the fabric;

a transport tube for returning the fabric from a front end of the vat toward a rear end of the vat, the fabric forming a closed rope form; and means for injecting a gas stream located in a direction of travel of the fabric between a point where the fabric returns to the storage zone and the hydraulic and/or mechanical means for driving the fabric.

2. The machine for wet treatment as claimed in claim 1, wherein the means for injecting a gas stream are located within a region of the rear end of the vat along a path of the fabric downstream of the transport tube for returning the fabric to the vat.

3. The machine for wet treatment as claimed in claim 2, further comprising a defecting roller arranged on the path of the fabric between said transport tube and the means for injecting a gas stream.

4. The machine for wet treatment as claimed in claim 3, wherein the transport tube includes a short perforated tube which is extended into the vat adjacent to the rear end of the vat and surmounted by the deflecting roller.

5. The machine for wet treatment as claimed in claim 2, wherein the transport tube includes a bent tube extended into the vat, the bent tube having a downstream end connected directly to the means for injecting a gas steam.

6. The machine for wet treatment as claimed in claim 1, wherein the means for injecting a gas stream are arranged in an intermediate region of the vat and divide the storage zone into two parts.

7. The machine for wet treatment as claimed in claim 1, further comprising a branch duct through which the fabric to be treated passes, the branch duct being connected to an intermediate region of the vat, and the means for injecting a gas stream being connected to the branch duct.

8. The machine for wet treatment as claimed in claim 1 wherein the means for injecting a gas stream comprises a gas injection nozzle placed within the vat and connected to a fan located outside the vat, the fan comprising at least one gas intake in an upper part of said vat.

9. The machine for wet treatment as claimed in claim 8, wherein the fan comprises a plurality of gas intakes distributed over the length of the vat.

10. The machine for wet treatment as claimed in claim 1 wherein the means for injecting a gas stream comprise an inner duct, through which the fabric passes, and an outer nozzle for the injection of gas, the inner duct being widened and flattened horizontally.

11. The machine for wet treatment as claimed in claim 10, wherein the nozzle is prolonged forward by a deflector.

12. The machine for wet treatment as claimed in claim 11, wherein the deflector is adjustable from outside.

* * * * *